US005466089A

United States Patent [19]

Jurik

[11] Patent Number: 5,466,089

[45] Date of Patent: Nov. 14, 1995

[54] GROUND AND FLOOR COVERING BLOCK

[76] Inventor: Dean Jurik, 5131 N. 15 Rd., Mesick, Mich. 49668

[21] Appl. No.: 368,011

[22] Filed: Jan. 3, 1995

[51] Int. Cl.[6] ..... E01C 5/00

[52] U.S. Cl. ..... 404/34; 404/37; 404/39; 404/41; 52/596; 52/603

[58] Field of Search ..... 404/29, 34, 37–42; 52/596, 603, 604, 311.1, 311.2, 608

[56] References Cited

FOREIGN PATENT DOCUMENTS 2751536 5/1979 Germany .
3217737 12/1982 Germany .
3409114 9/1985 Germany .

*Primary Examiner*—Ramon S. Britts
*Assistant Examiner*—Pamela A. O'Connor
*Attorney, Agent, or Firm*—Douglas S. Bishop

[57] ABSTRACT

A paving block for covering the ground, floor and like surfaces. The paving block is generally planar with a vertical dimension. The upper and lower planar surfaces and the vertical sides define a pentagon. the pentagon has three longer sides and two shorter sides. Two of the longer sides are equal. The third longer side is at least as long as the two equal longer sides. The two equal longer sides are joined at one end at a 90° internal angle. Each is joined at its opposite end to one of the shorter sides at a 90° internal angle and each shorter side is then joined at a 135° internal angle to the third longer side. The third longer side opposes the right angle between the two equal longer sides and is bisected by a line bisecting the 90° angle between the two equal longer sides. The pentagonal paving block may be used to create homogeneous designs or in combination with a square paving block, the exterior sides of which are equal in length to the adjoining longer sides of the pentagonal block.

36 Claims, 8 Drawing Sheets

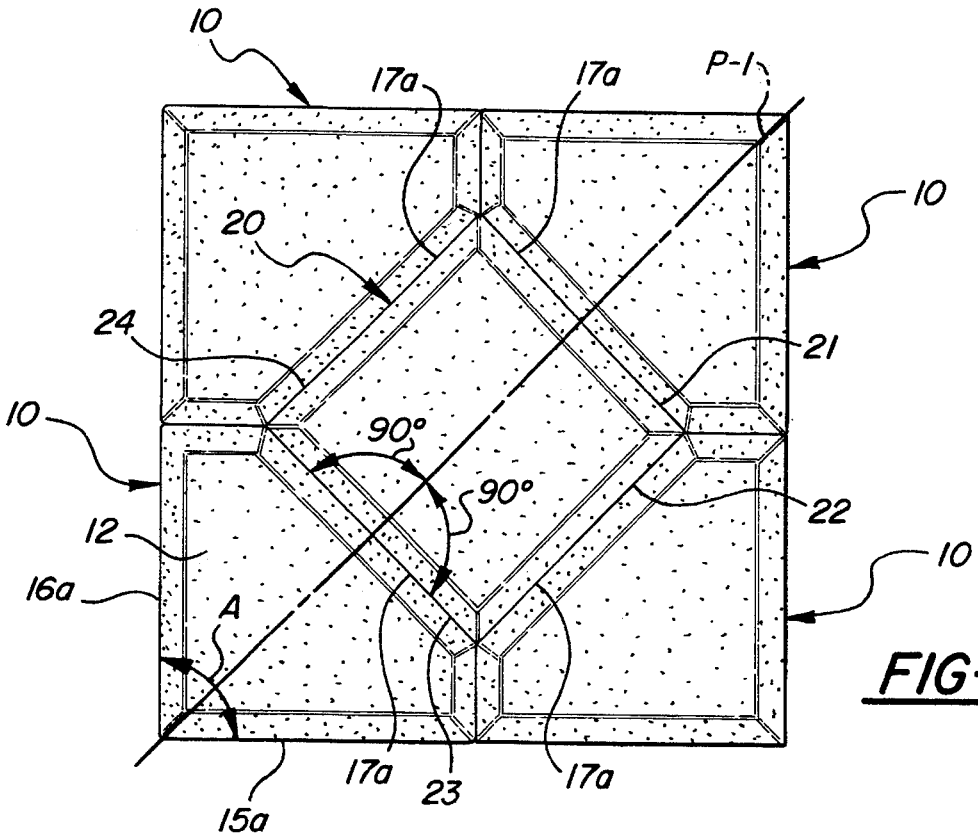
FIG-3
FIG-4
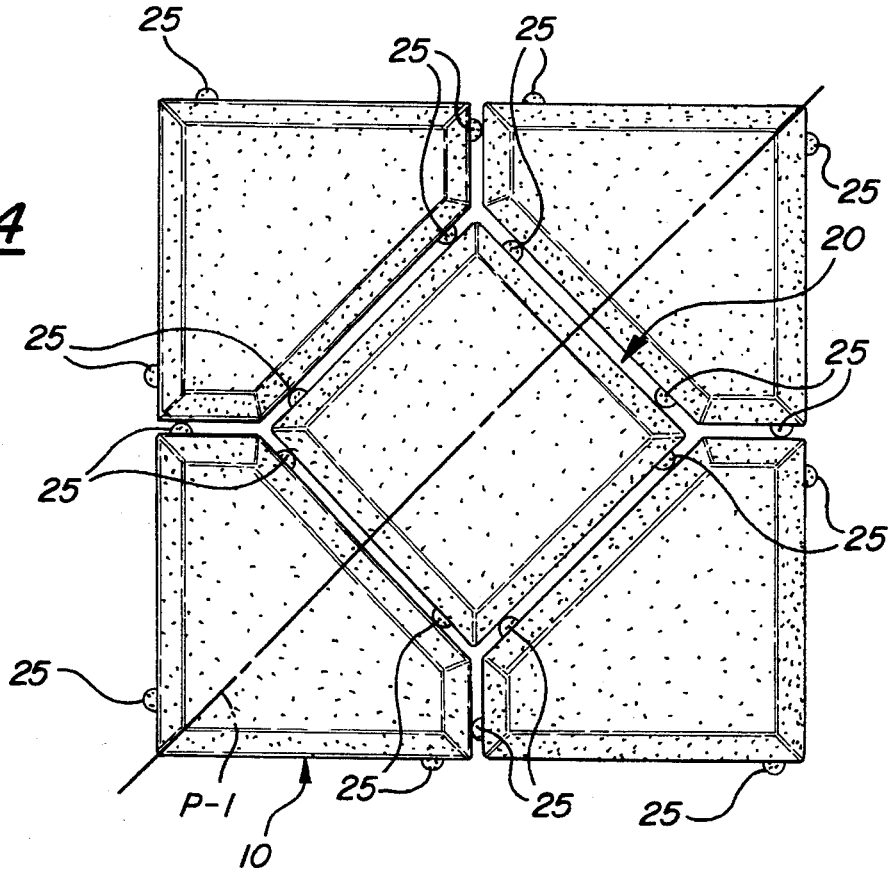

FIG-11
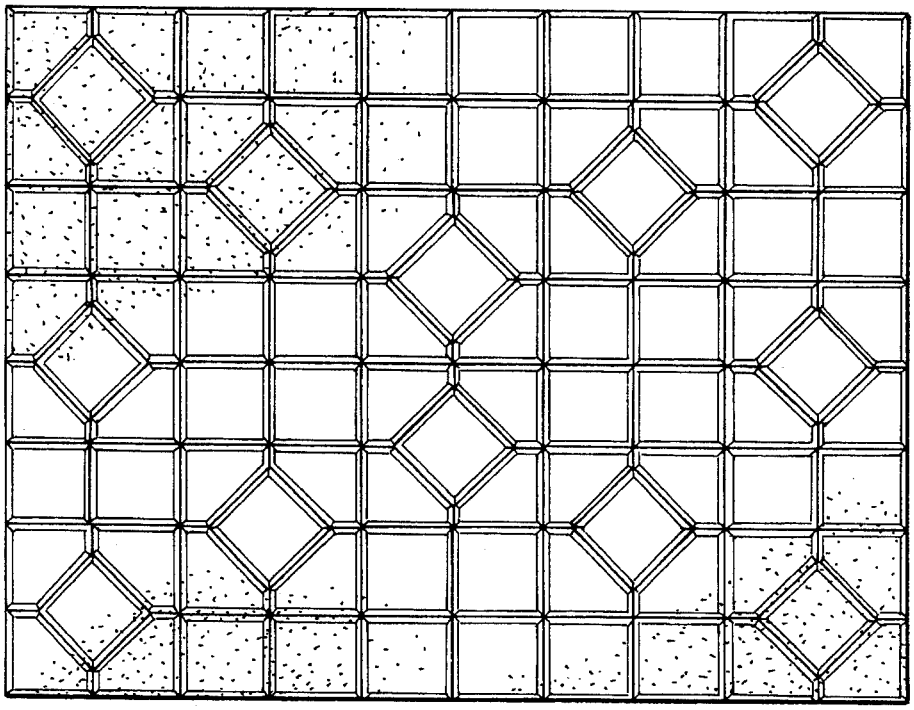
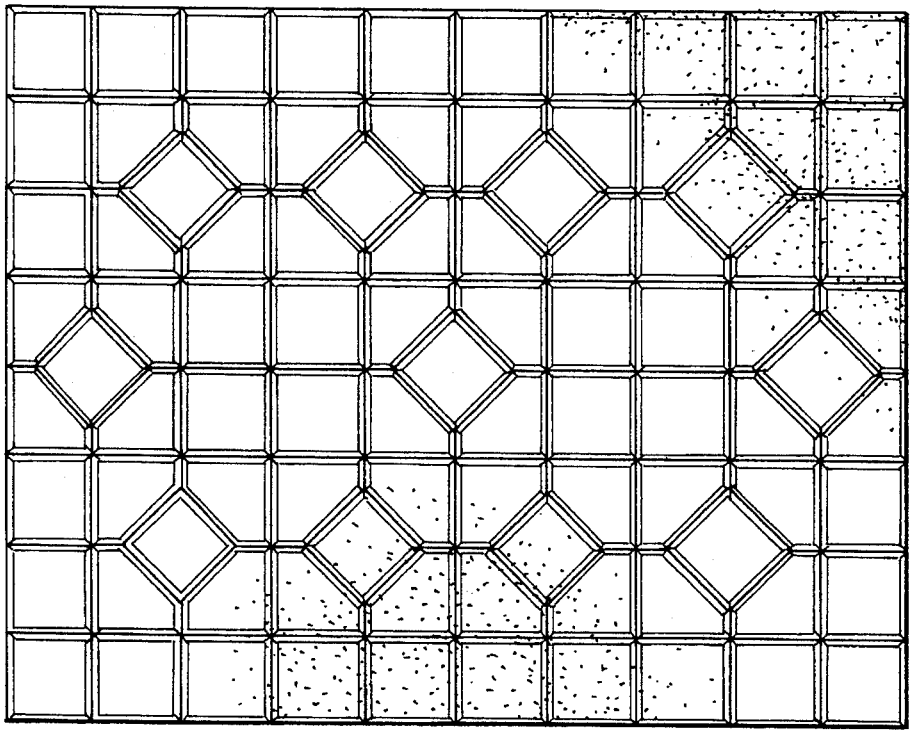
FIG-12

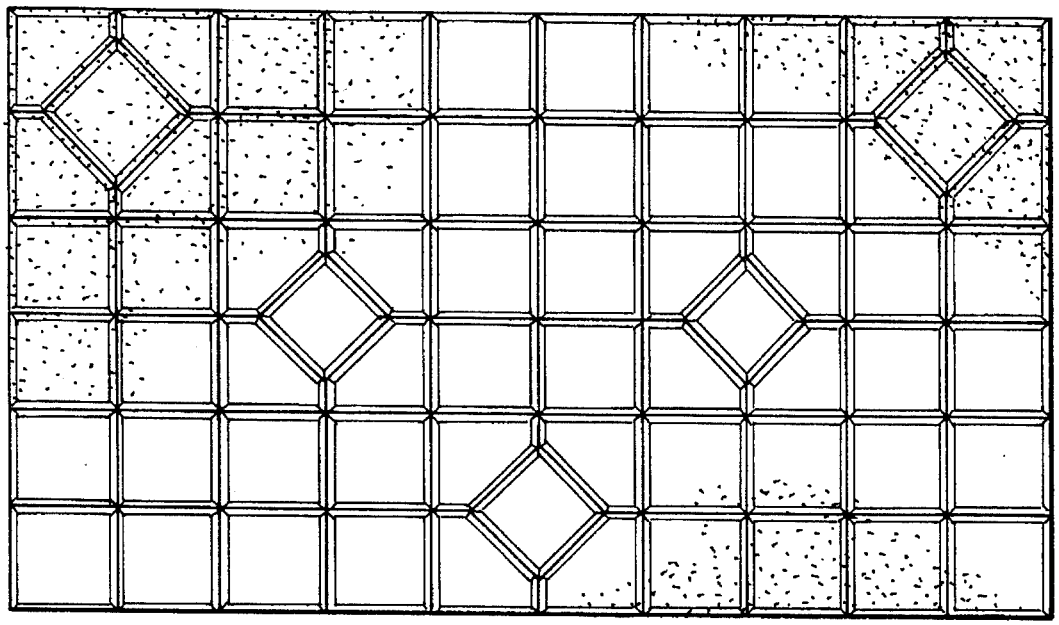
FIG-13
FIG-14
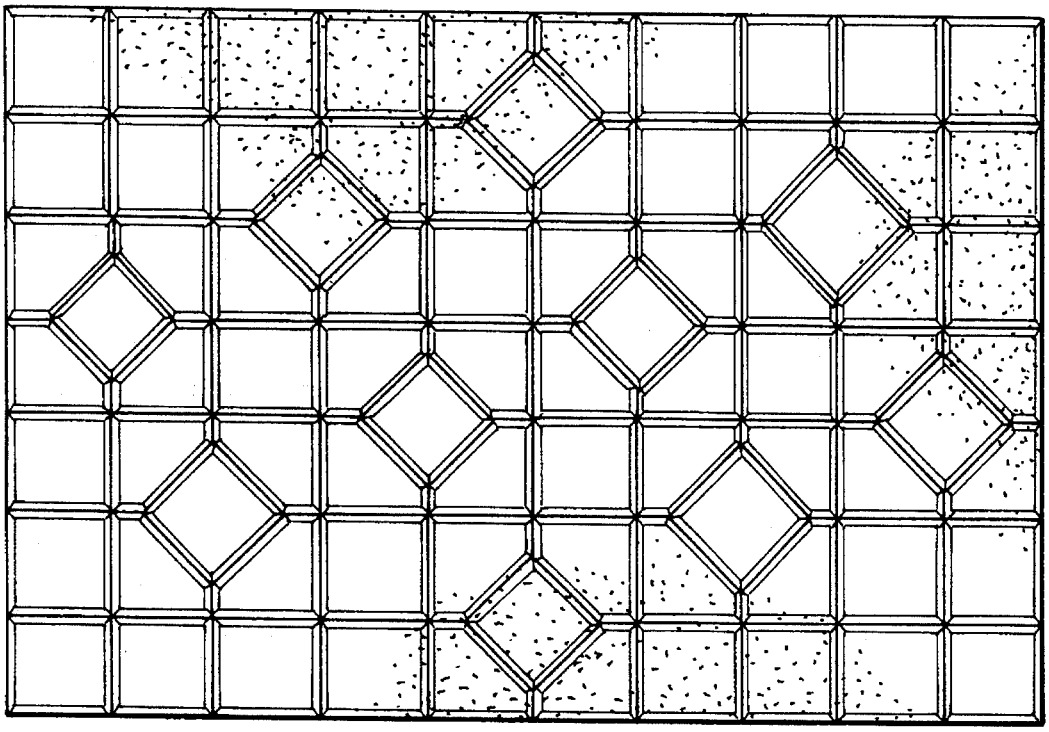

GROUND AND FLOOR COVERING BLOCK

BACKGROUND OF THE INVENTION

This invention relates to paving blocks for covering the ground, floor, and like surfaces and, more specifically, to a paving block, pentagonal in shape, which performs functions of existing paving blocks, but which additionally allows a multitude of modifiable pentagon and square paving block combinations with the use of only two different paving blocks.

The concept of utilizing paving blocks or pavers for covering the ground or like surfaces is known. U.S. Pat. No. 474,339, issued to Graham, discloses a paving block or building block of polygonal profile, relating to street and sidewalk pavements. Paving blocks utilizing basic square or rectangular shapes have long existed. A multitude of prior art exists directed to paving blocks or ground covering elements of more complex dimensions. U.S. Pat. No. 3,494,266, issued to Baumberger, discloses a paving stone having complementary concave and convex sides. U.S. Pat. No. 4,544,305, issued to Hair, discloses an interlocking slab element comprising a main hexagonal section with one or more attached tail sections which may be aligned in a variety of configurations. U.S. Pat. No. 5,173,003, also issued to Hair, is likewise directed to a paving stone or slab element having a hexagonal section and a square section. U.S. Pat. No. 4,128,357, issued to Barth, discloses a ground covering slab element comprised of an octagonal head portion and a square or circular stem portion. U.S. Pat. No. 4,711,599, issued to Glickman, discloses a six-sided paving block in a "chevron" shape. U.S. Pat. No. 5,108,219, issued to Hair, discloses an interlocking paving block having a twelve-sided main section and an eight-sided tail section. U.S. Pat. No. 5,054,957, issued to Johnson, II, discloses another multi-sided paving block which provides paving in the way of adjacent like blocks laid in various patterns. The above-referenced prior art is generally directed to continual patterns of the same paver or slab elements, albeit a variety of patterns may be available with a single block.

The use of a general pentagonal shape in block construction for ground covering, floor covering, or like surfaces is also known. Great Britain Patent No. 209,316, issued to Wettern, discloses a pentagonal block utilized to "edge" pavement comprised of diagonally disposed rectangular homogeneous elements. European Patent Office Patent No. 0415093A1, issued to Fünfeck-Stein, discloses a pentagonal paving element having 2 longer side dimensions and three shorter side dimensions for use both in patterns of homogeneous elements and in patterns with interspersed squares and rectangles.

While all of the referenced prior art relates, in some respect, to polygonal paving blocks, tiles or pavers, for the most part, all of said inventions are directed primarily towards arrangements of homogeneous elements of the respective invention. To the extent that said referenced prior art discloses a pentagonal block used in combination with other shapes, the pentagonal blocks are utilized solely to create a linear edge to the paving pattern, as in the Wettern patent, or require a minimum of three paver dimensions to complete a paving pattern, as in the Fünfeck-Stein patent.

Paving blocks or elements such as those disclosed in the referenced prior art are often used in the construction of roadways, sidewalks, patios, decks, floors, embankments, and other like uses. They are typically chosen over monolithic-type slabs for durability, aesthetic, quality, pattern variety and ease of installation replacement and pattern modification.

The referenced prior art and its progeny have each been able to address these various qualities with varying degrees of success, but none have been able to satisfactorily address all of the qualities in an optimum manner.

Existing paving blocks or elements may be generally grouped into two categories. These are, on the one hand, paving blocks which allow a linear edge to the paving pattern and, on the other hand, those that require cutting of elements or special pieces to create a linear edge.

While paving blocks which are square or rectangular in shape have long been known to supply a linear pattern edge, they lack significantly in the areas of aesthetic quality and pattern variety. The more complex paving blocks, such as those shown in the referenced prior art, provide great advantage in the areas of aesthetics and pattern variety, but, because of the variety of sizes and shapes required to obtain a linear pattern edge, often this advantage comes at the expense of installation economy.

Additionally, the referenced prior art paving blocks or elements require selection of a pre-set pattern which may not be significantly deviated from.

Additionally, in the field of ceramic tile, a configuration is known which is often categorized as "pentagon and dot." In this configuration, combinations of four pentagonal tiles having two longer sides at right angles to each other and three shorter sides, one of which opposes the right angle, surround a square tile whose exterior side dimensions equal the length of the opposing shorter sides of the pentagons. This design does not allow interchangability of the square tile used as the "dot" and square tiles which may be used to separate the groups of pentagons. The interchangability of the "dot" and square tiles is a critical consideration in manufacturing. The manufacturer incurs considerable expense in making the molds for each individual paving block or tile. Any innovation in the field which allows a lesser number of different size units to be utilized in any pattern will result in significant cost savings and commercial advantage to the manufacturer. Further, "pentagon and dot" has limited application in paving block applications laid over a sand base, because the difference in size of the pentagonal and square tiles does not facilitate uniform compaction and resistance to loads.

Accordingly, a need exists for a paving block for covering the ground, floor, or like surfaces, which provides for ease in installation by providing a linear pattern edge, but which also addresses aesthetic considerations and ease of installation, replacement and modification. Specifically, what is needed is a complex paving block, capable of being used in homogeneous patterns, in the same manner as the referenced prior art, but which may also be used in combination with no more than one additional shape and size of block to create patterns which have linear edges, without the need of cutting, and which patterns may be irregular or regular and may be modified during or after initial installation.

SUMMARY OF THE INVENTION

This invention is directed to provision of a paving block for covering the ground, floor, and like surfaces which will permit aesthetic designs and ease of installation, replacement and modification.

More specifically, this invention is directed to provision of a pentagonal paving block which may be used in combination with a square paving block to provide patterns which have linear edges without the need of cutting or providing additional specially sized paving blocks.

An additional object of the invention is to provide a paving block which is adaptable to homogeneous patterns as is currently known.

According to an important feature of the invention, the paving block is pentagonal in shape with three essentially equal longer sides, two of which are at right angles to each other and the third of which opposes said right angles. The invention consists of a pentagonal block defined by a flat upper surface and lower surface with vertical side surfaces at each of the five sides of the pentagon. In the primary embodiment of the invention, three longer sides are essentially equal and two shorter sides are essentially equal. Two of the equal longer sides meet at a 90° angle and are opposed by the third equal longer side. The two shorter sides are each joined to one of the adjacent longer sides at a 90° angle and are each, in turn, joined to the opposing longer side at a 135° angle.

According to a further feature of the invention, a combination of four pentagonal paving blocks surrounding a square paving block so that the exterior dimension of the four pentagonal blocks is a square is interchangeable with four square paving blocks, each of which is equal in dimension to the surrounded square paving block.

According to a further feature of the invention, the paving block may be used in combination with only one additional size and shape of block to create patterns which have linear edges and which patterns may be regular or irregular and may be modified during or after initial installation.

According to a further feature of the invention, the pentagons and squares which may be used are similar in size, sufficient to allow for uniform compaction and load resistance when in place.

According to a further feature of the invention, spacer bars may be utilized on the vertical side surfaces of the paving block to assure proper spacing between stones. When spacer bars are utilized, the length of the opposing longer side of the pentagonal block may be increased slightly, but not more than 10%, sufficient to allow four pentagonal blocks with spacers to form a square the sides of which equal two times the length of one of the longer sides plus the width of a spacer bar, so as to permit a square block, each side of which equals one of the longer adjacent sides of the pentagon, to be snugly placed in the middle of said four pentagonal blocks.

According to a further feature of the invention, the paving block may be utilized in patterns for ground, floor or like surfaces covering wherein a combination of the paving blocks and other blocks are placed leaving a uniform space between the adjacent vertical side surfaces of the paving blocks and the other blocks utilized in the pattern. When a uniform space is used between elements of a pattern, as stated, the length of the opposing longer side of the pentagonal block may be increased slightly, as with the use of spacer bars, but not more than 10 percent, sufficient to allow four pentagonal blocks with uniform spaces between their adjacent shorter side surfaces to form a square, the sides of which equal two times the length of one of the longer sides of one of the pentagonal blocks plus the width of the uniform space, so as to permit a square block, each side of which equals one of the longer adjacent sides of the pentagon to be placed in the middle of said four pentagonal blocks leaving the same uniform space between each side of the square block and the opposing adjacent sides of the four pentagonal blocks.

According to a further feature of the invention, the paving block may be utilized in a nearly infinite number of different patterns, the number of different patterns being limited only by the size of the area of ground, floor or like surface to be covered.

According to a further feature of the invention, the upper edges of the paving block may be beveled to prevent the upper edge of the paving block from catching on shovel or plow blades or the like.

According to a further feature of the invention, the invention may be constructed of brick, concrete, ceramic tile, or like material.

The above and additional features of the invention may be considered and will become apparent in conjunction with the drawings in particular, and the detailed description which follows.

BRIEF DESCRIPTION OF DRAWINGS

FIG. 3 is a top view of one preferred embodiment of the invention in which four paving blocks of this invention are arranged in concert with one square paving block showing the relative dimensions of the invention and the square block FIG. 4 is a top view of an embodiment of the invention which includes spacer bars, in which four paving blocks of this invention are arranged in concert with one square paving block showing the relative dimensions of the invention and the square block when spacer bars are utilized.

FIG. 11 is a top view of a repeating third closed pattern when only two different size blocks are necessary to complete the pattern.

FIG. 12 is a top view of a repeating fourth closed pattern when only two different size blocks are necessary to complete the pattern.

FIG. 13 is a top view of a repeating fifth closed pattern when only two different size blocks are necessary to complete the pattern.

FIG. 14 is a top view of a repeating sixth closed pattern when only two different size blocks are necessary to complete the pattern.

DETAILED DESCRIPTION OF THE PREFERRED EMBODIMENT

Figure 1:
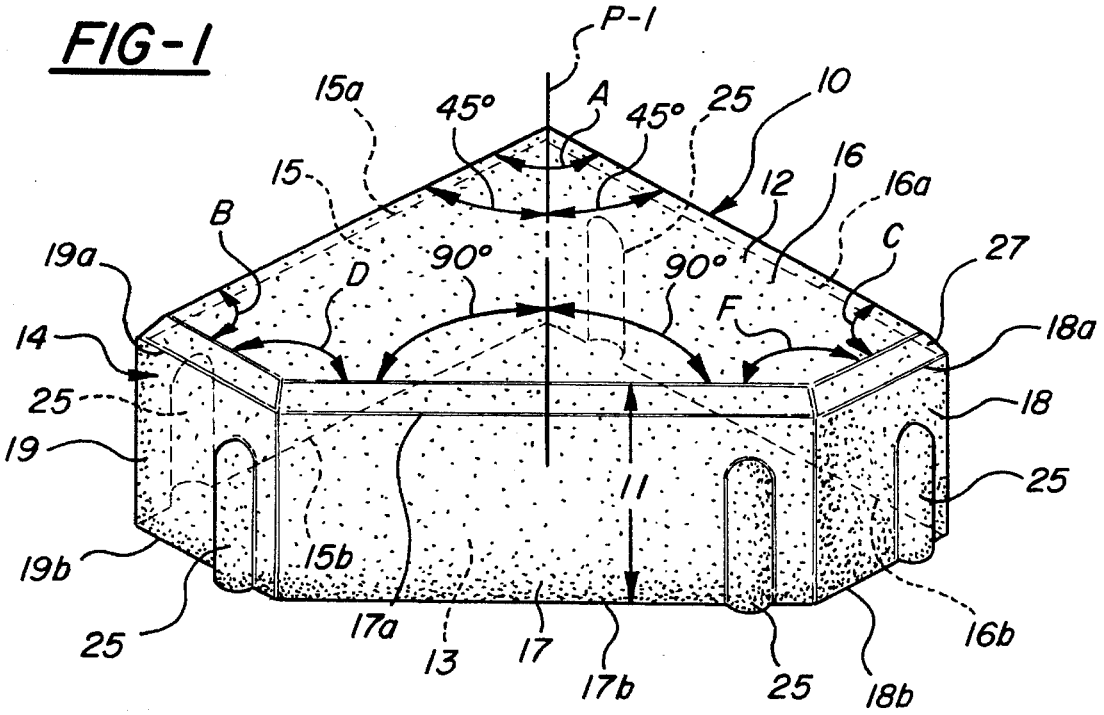
FIG. 1 is a perspective view of a preferred embodiment of the paving block embodying this invention with hidden lines demonstrating dimensions hidden from view.

The invention paving block for covering the ground, floor and like surfaces, broadly considered, includes a generally pentagonal block 10 having a vertical dimension 11. The pentagonal block 10 further comprises a five-sided planar upper surface 12 and a corresponding five-sided planar lower surface 13 parallel to the upper planar surface 12. The pentagonal block 10 has vertical dimension 11 which is comprised of a unitary side wall 14, which is further comprised of five vertical side surfaces 15, 16, 17, 18 and 19. Side surfaces 15, 16 and 17 are longer side surfaces. Side surfaces 18 and 19 are shorter side surfaces. Longer side surfaces 15 and 16 are essentially equal in length. The third longer side surface 17 is at least as long as side surfaces 15 and 16.

Side surfaces 15, 16, 17, 18 and 19 extend between upper surface 12 and parallel lower surface 13 at each of the sides 15*a*, 16*a*, 17*a*, 18*a* and 19*a* of upper surface 12 and each of the corresponding sides 15*b*, 16*b*, 17*b*, 18*b* and 19*b* of lower surface 13.

Side surfaces 15 and 16 are joined at one end at a 90° internal angle, designated as angle A in FIG. 1. Side surfaces 15 and 16 are each further joined to an end of side surfaces 19 and 18, respectfully, at 90° internal angles designated as angles B and C in FIG. 1. The opposite ends of side surfaces 18 and 19 are each further joined to side surface 17 at 135° internal angles, designated as angles D and F in FIG. 1.

Side surface 17 which opposes side surfaces 15 and 16 and angle A between them, is at least as long as side surfaces 15 and 16 and is perpendicular to and bisected by a vertical plane designated as P-1 in FIG. 1. Vertical plane P-1 further bisects internal angle A between surfaces 15 and 16.

As shown in FIG. 3, vertical plan P-1 correspondingly bisects side 17*a* of side surface 17 and bisects internal angle A between sides 15*a* and 16*a*.

In the preferred embodiment of the invention the block 10 may be utilized in conjunction with a square block 20. Square block 20 has a vertical dimension 21A identical to the vertical dimension 11 of pentagonal block 10. Square block 20 has four identical side surfaces 21, 22, 23 and 24, each being of equal dimension to side surfaces 15 and 16 of block 10. Block 20 is used in conjunction with block 10 in a position where, when side surface 17 of block 10 is juxtaposed against any side surface 21, 22, 23, or 24, vertical plane P-1 will also bisect the adjacent side surface of square block 20. This is shown in FIG. 3 as bisecting sides 23 and 21 of square block 20.

Figure 2:
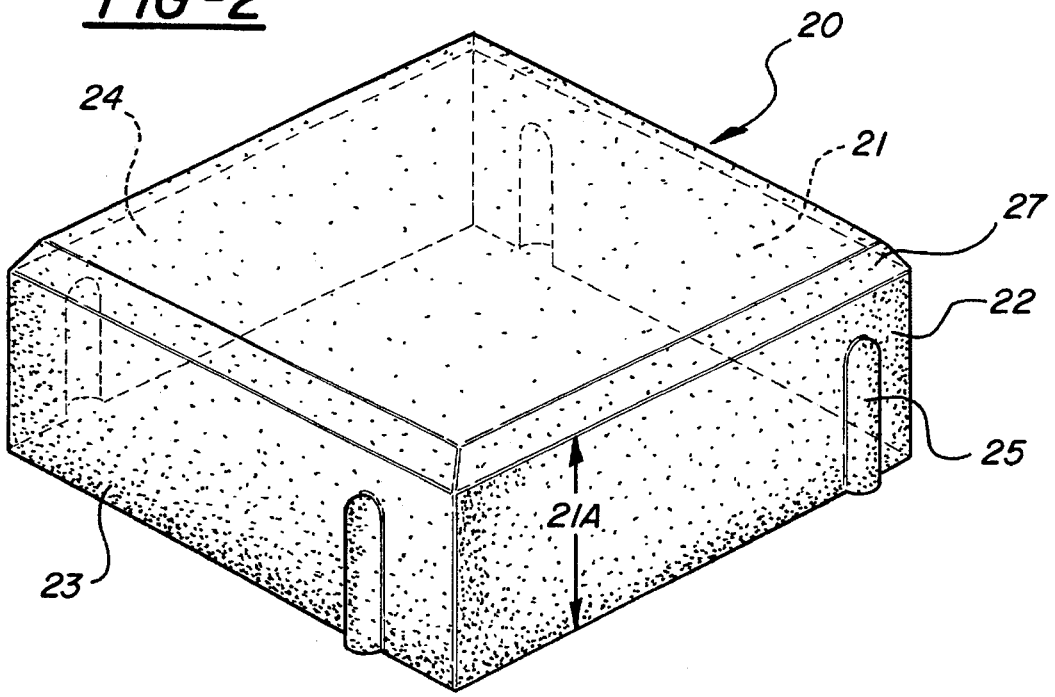
FIG. 2 is a perspective view of a square paving block used in conjunction with the paving block embodying this invention with hidden lines demonstrating dimensions hidden from view.

In a further preferred embodiment of the invention each side surface 15, 16, 17, 18 and 19 of block 10 has at least one outwardly disposed spacer bar 25. Said spacer bar 25 may extend vertically as shown in FIGS. 1 and 2. Said spacer bar may alternately be a projection or nub of any vertical height.

The outward projection of the spacer bar 25 from the respective side surfaces 15, 16, 17, 18 and 19 would be essentially uniform and normally within a range of zero to one millimeter from the side surfaces.

Figure 5:
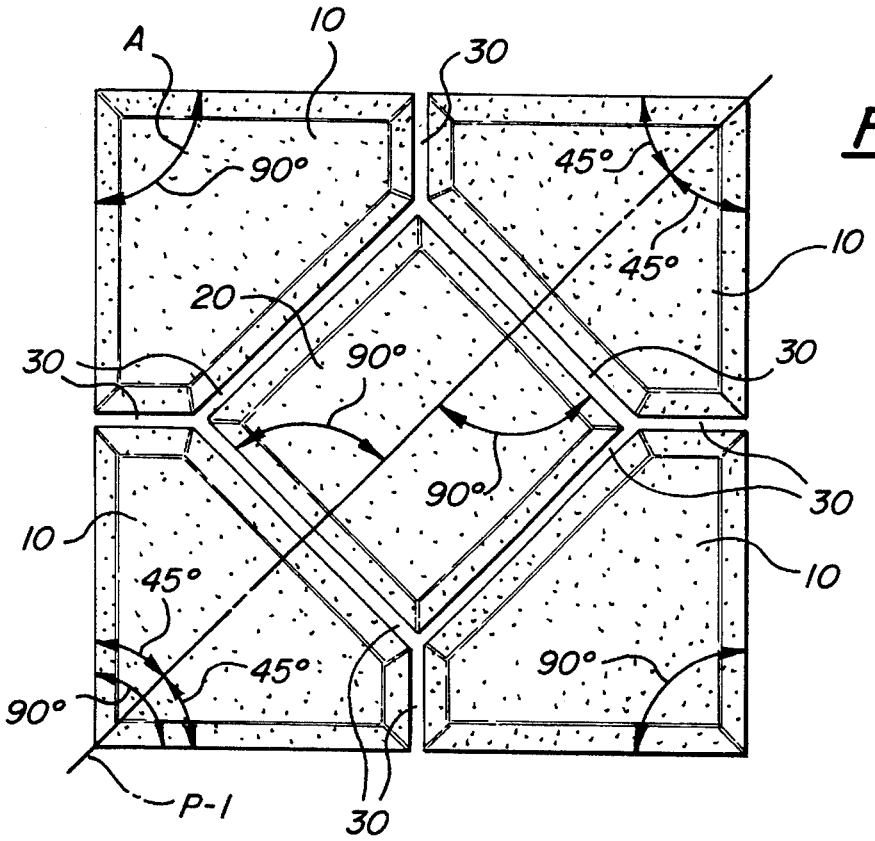
FIG. 5 is a top view of an embodiment of the invention in which four paving blocks of this invention are arranged in concert with one square paving block with a uniform space between the opposing sides of said blocks showing the relative dimensions in said arrangement.
Figure 6:
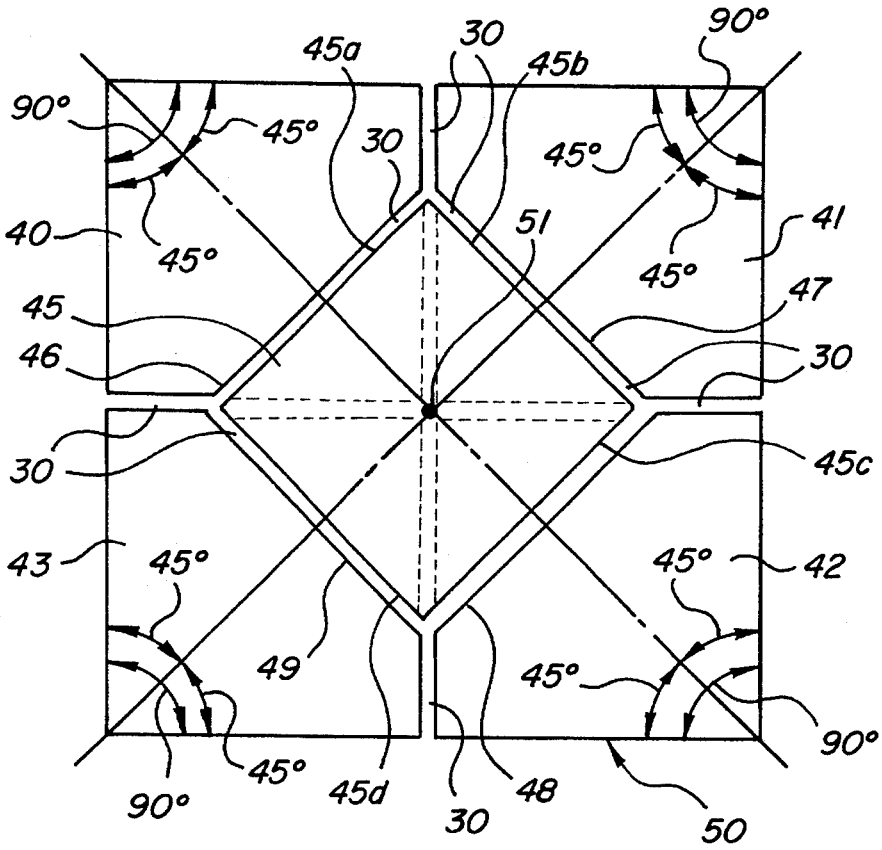
FIG. 6 is a top view of a configuration of four equal squares with an overlaying fifth square demonstrating the relationship of the distance between paving blocks and the lengths of the side surfaces of the invention.

In a further preferred embodiment of the invention, when utilized as elements of ground, floor or like surfaces covering, the paving blocks may be placed utilizing a uniform spacing separation between adjacent side surfaces in the pattern. This uniform space may be referred to in ceramic tile applications as a grout joint and may be referred to in other applications as a space joint. FIG. 5 demonstrates a configuration of one square block 20 surrounded by four pentagonal blocks 10 of the present invention utilizing a uniform space 30, between all opposing side surfaces of the respective elements.

When spacer bars 25 or alternative projections or nubs are not utilized in the preferred embodiment of the invention, side surface 17 will be essentially equal in length to side surfaces 15 and 16. When spacer bars 25 or alternative projections or nubs are utilized, in another preferred embodiment of the invention, the length of side surface 17 will exceed the length of side surfaces 15 and 16 by up to 10 percent of the equal length of said side surfaces 15 and 16. The appropriate length of side surface 17 within said 10 percent range is dependent upon the distance of uniform projection of the spacer bars 25 or alternative projections or nubs from side surfaces 15, 16, 17, 18 and 19 in order to facilitate placement of a square block 20 snugly within an arrangement of four pentagonal blocks 10 arranged in contact with each other as shown in FIG. 4 so that the side surfaces forming the 90° internal angle A of each pentagonal block 10 forms one internal 90° angle of the perimeter of a generally square area. In such a configuration, as shown in FIG. 4, vertical plane P-1 will bisect square block 20.

In a further preferred embodiment of the invention, if the paving block is to be utilized in patterns utilizing a uniform width between the opposing side surfaces of all elements in the pattern, the length of side surface 17 will exceed the length of side surfaces 15 and 16 by up to 10 percent of the equal length of said side surfaces 15 and 16. The appropriate length of side surface 17 within said 10 percent range is dependent upon the width of the uniform distance between the opposing side surfaces 15, 16, 17, 18 and 19 in order to facilitate placement of a square block 20 within an arrangement of four pentagonal blocks 10 arranged with a uniform space 30 between the adjoining side surfaces of each, as shown in FIG. 5, so that the side services forming the 90° internal angle A of each pentagonal block 10 forms one internal 90° angle of the perimeter of a generally square area, and the square block 20 is fitted within said arrangement providing an equal uniform space 30 between each side surface of the square block 20 and the opposing side surface of each of the four pentagonal blocks 10. In such a configuration, as shown in FIG. 5, vertical plane P-1 will bisect square block 20.

When spacer bar 25, or alternative projections or nubs are utilized, or when blocks are manufactured to be installed with a uniform space between adjoining blocks, the length of side surface 17 may be determined by placing four equal squares 40, 41, 42 and 43, said squares having sides equal in length to the equal longer side surfaces 15 and 16 of pentagonal block 10, in such a manner that said four squares 40, 41, 42 and 43 are separated from each other on two sides of each square by the width of the desired spacer bar 25, or other projection or nub, or by a uniform distance 30 between the opposing sides of each square 40 to form a larger square 50. A fifth square 45 is then superimposed over the new larger square 50, the center 51 of said fifth square 45, being located directly over the center 51 of the new larger square 50 with the sides 45*a*, 45*b*, 45*c* and 45*d* of said fifth square 45 each being respectively bisected by a line bisecting one of the 90° internal angles of the larger square 50. Lines 46, 47, 48 and 49 are then drawn parallel with and outboard a distance equal to uniform distance 30 of each of the sides 45*a*, 45*b*, 45*c* and 45*d* respectively, of the fifth square 45. The distance between the points where lines 46, 47, 48 and 49 intersect two sides of squares 40, 41, 42 and 43, respectively, for each square will define the length of side surface 17.

Figure 7:
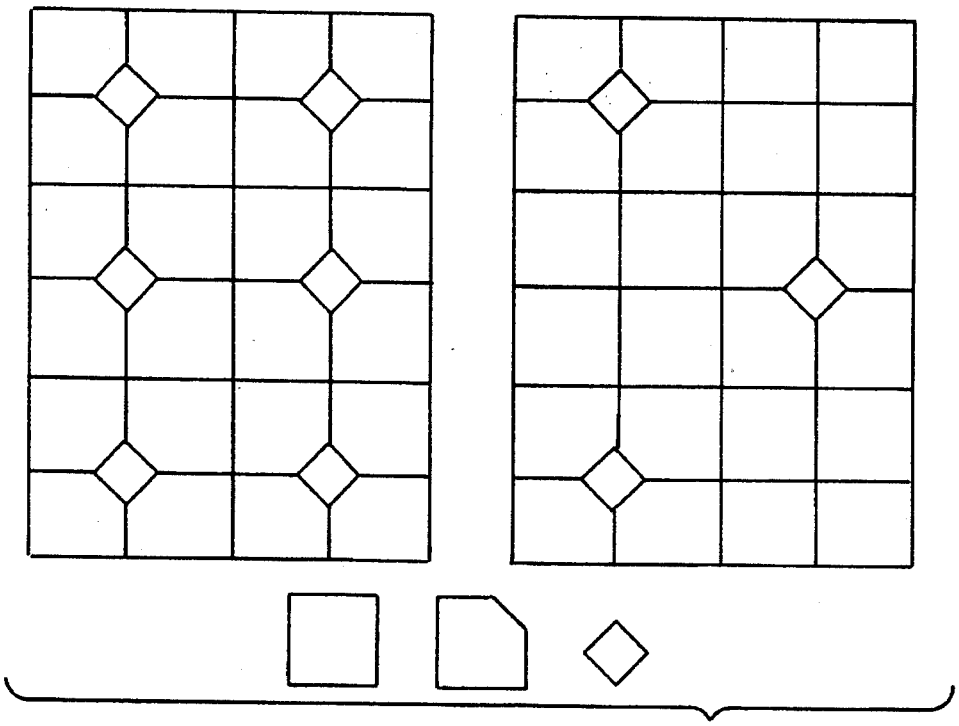
FIG-7 PRIOR ART
FIG. 7 is a top view of prior art utilizing pentagon and square combinations including a top view of the relative dimensions of three different size blocks necessary to complete the pattern.

FIG. 7 illustrates a top view illustration of prior art utilizing a "pentagon and dot" design wherein the sides of the square block or "dot" are shorter than the longer sides of the pentagonal block requiring three shapes to complete all but a continuous, non-modifiable pattern.

Figure 8:
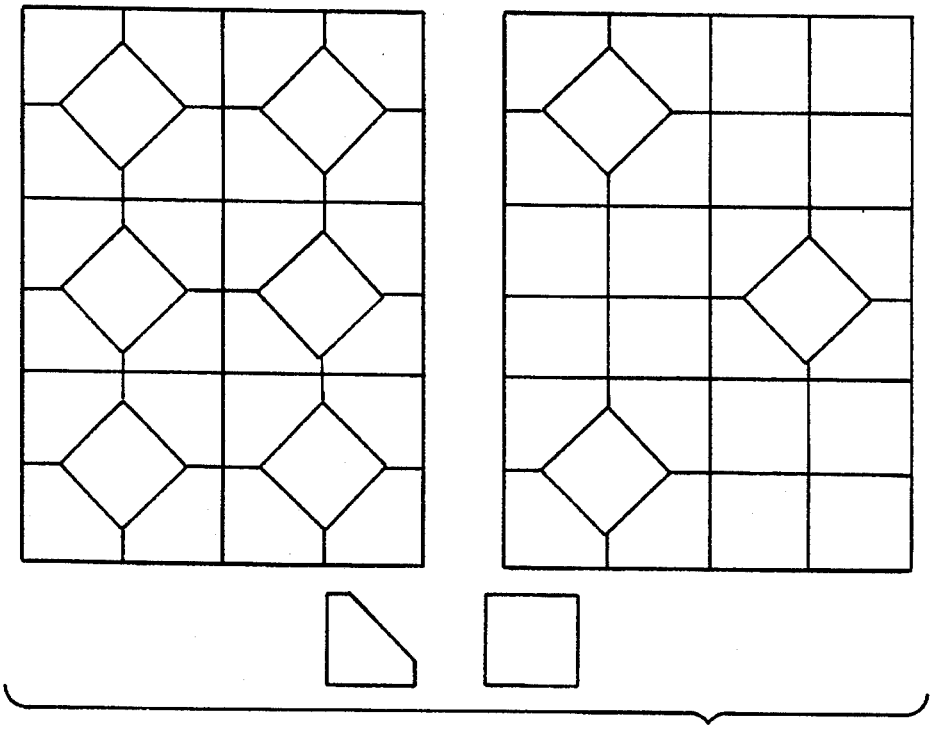
FIG. 8 is a top view of paving configurations of the invention including a top view of the relative dimensions of the only two different size blocks necessary to complete the pattern.

FIG. 8 illustrates a top view of a block configuration in the preferred embodiment of the invention. While a continuous uniform pattern is still possible using the configuration illustrated in FIG. 3, or when spacer bars 25 are utilized, as illustrated in FIG. 4, only two shapes are required to construct or modify varying block configurations. As illustrated, the preferred embodiment of the invention provides a ground floor or like surfaces covering comprising a combination of at least two pentagonal blocks 10 and at least one square block 20.

In a further preferred embodiment of the invention the side surface 17 of each pentagonal block 10 corresponds with one side surface of a square block 20. In such a configuration the dimensions of side surfaces 21, 22, 23 and 24 of the square block 20 equal the dimension of side surfaces 15, 16, and 17 of the pentagonal block, as illustrated in FIG. 3. If spacer bars 25 or alternative projections or nubs are utilized the length of the side surface 17 of pentagonal block 10 may exceed the length of side surfaces 15 and 16 and side surfaces 21, 22, 23 and 24 by not more than 10 percent.

Figure 9:
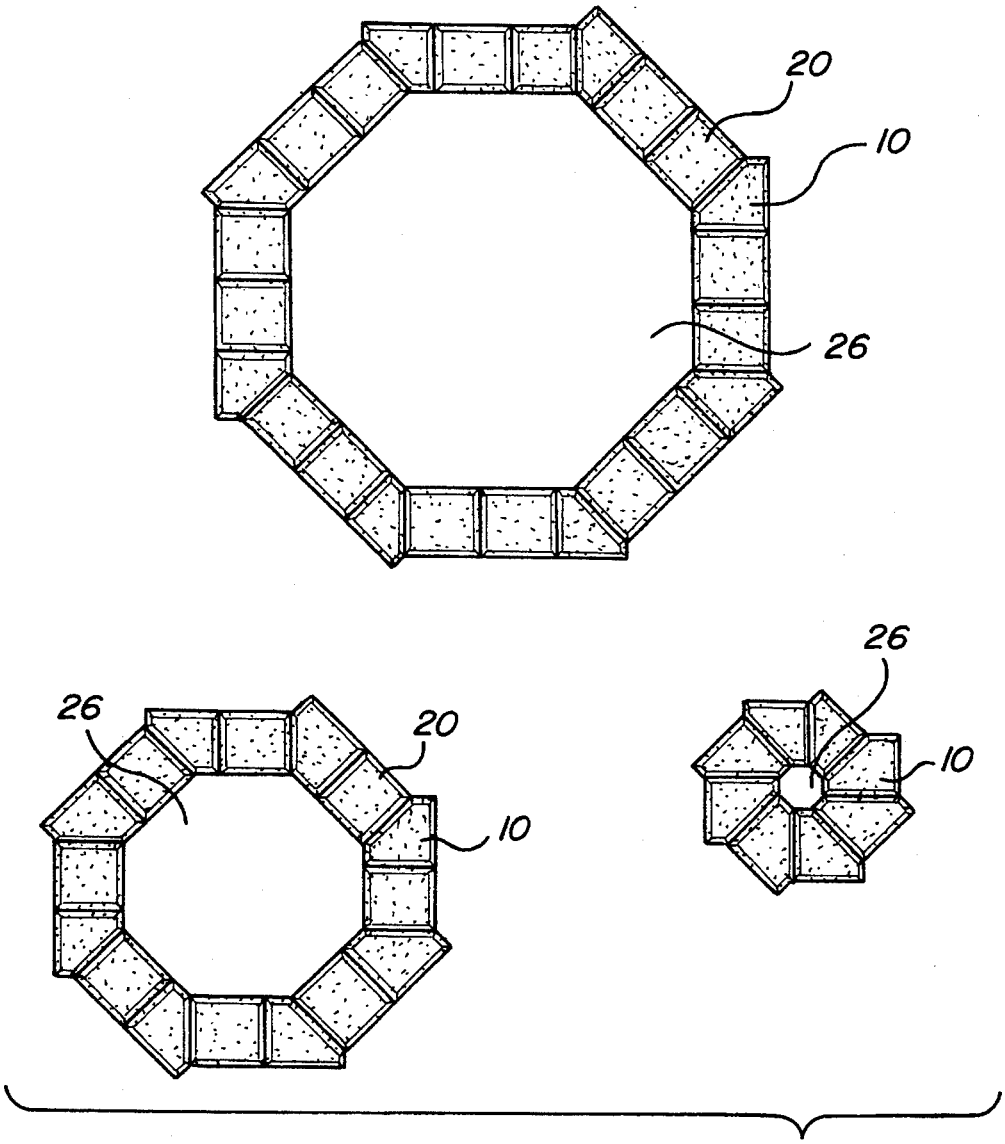
FIG. 9 is a top view of representative circular patterns of this invention with and without square paving blocks in combination therewith.

In another preferred embodiment of the invention, as illustrated in FIG. 9, the pentagonal block 10 may be arranged in circular series defining a center aperture. The dimension of said center aperture may be enlarged by alternating each pentagonal block 10 with at least one square block 20.

Figure 10:
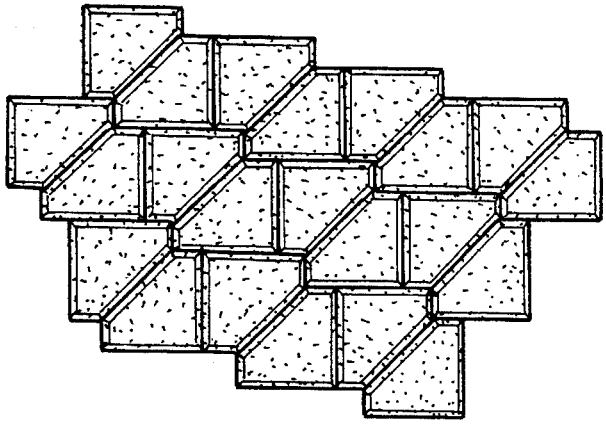
FIG. 10 is a top view of a homogeneous pattern of this invention.
Figure 15:
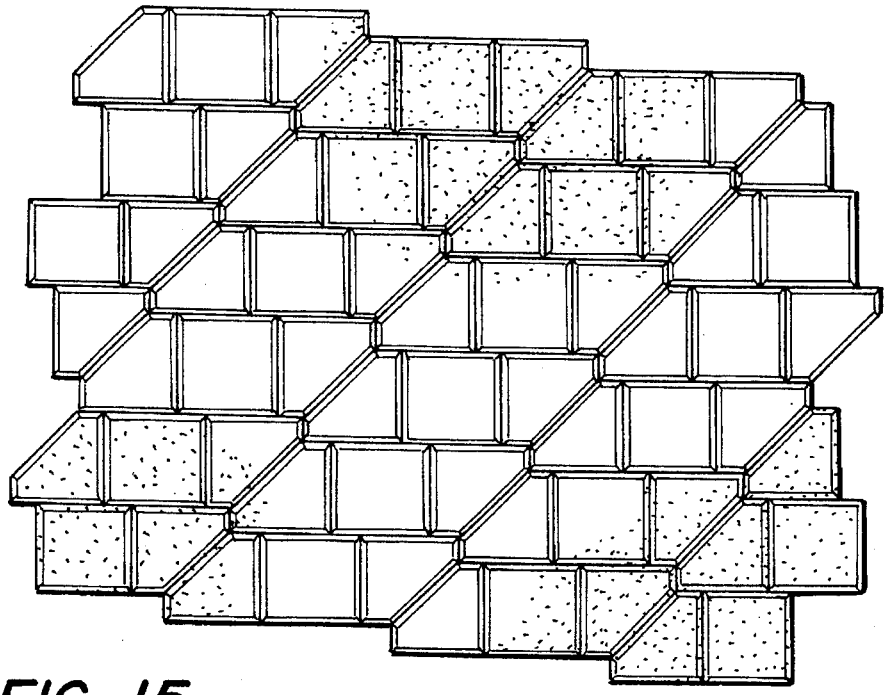
FIG. 15 is a top view of a repeating seventh closed pattern when only two different size blocks are necessary to complete the pattern.
Figure 16:
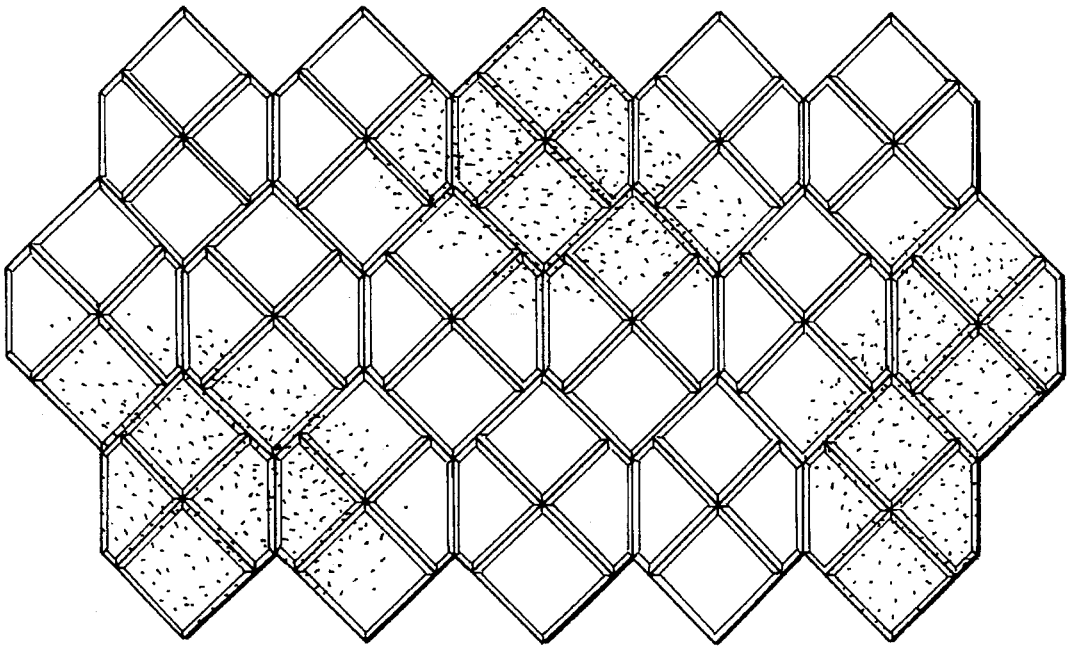
FIG. 16 is a top view of a repeating eighth closed pattern when only two different size blocks are necessary to complete the pattern.

In another preferred embodiment of the invention as illustrated in FIG. 10, the pentagonal block 10 may be arranged in a continuous pattern using only pentagonal blocks 10.

In another preferred embodiment of the invention, the edges 15*a*, 16*a*, 17*a*, 18*a* and 19*a* of the planar upper surface 12 of pentagonal block 10 are beveled as shown in FIGS. 1, 3 and 4.

The paving block of the present invention may be constructed of concrete, brick or ceramic tile composition, or other like suitable material.

WHEREAS, a preferred embodiment of the invention has been illustrated and described in detail, it will be apparent that various changes may be made in the disclosed embodiment without departing from the spirit of the invention.

What is claimed is:

1. A paving block for covering the ground, floor, and like surfaces comprising a body having a five-sided planar upper surface and corresponding parallel five-sided planar lower surface and five vertical side surfaces extending between said upper and lower surfaces at each of the corresponding sides thereof, said side surfaces including three longer side surfaces, two of said longer side surfaces being of essentially equal length with the third longer side surface being at least as long as said two equal longer side surfaces, and two shorter side surfaces of essentially equal length, two of said longer side surfaces of equal length being joined at one end at a 90° internal angle and each being further joined at its opposite end to an end of one of said shorter side surfaces at a 90° internal angle, with the opposite ends of said shorter side members each being joined at a 135° internal angle by a third opposing longer side surface at least as long as said equal longer side surfaces, said opposing longer side surface being perpendicular to and bisected by a vertical plane bisecting the 90° internal angle between said equal adjoining longer side surfaces.

2. A paving block according to claim 1 wherein the sides of the upper planar surface are beveled.

3. A paving block according to claim 1 wherein the body of said block comprises a brick composition.

4. A paving block according to claim 1 wherein the body of said block comprises a concrete composition.

5. A paving block according to claim 1 wherein the body of said block comprises a ceramic tile composition.

6. A paving block according to claim 1 wherein at least one of said vertical side surfaces further comprises at least one outwardly extending nub.

7. A paving block according to claim 1 wherein said opposing longer side surface is essentially equal in length to said equal adjoining longer side surfaces.

8. A paving block according to claim 7 wherein the sides of the upper planar surface are beveled.

9. A paving block according to claim 7 wherein the body of said block comprises a brick composition.

10. A paving block according to claim 7 wherein the body of said block comprises a concrete composition.

11. A paving block according to claim 7 wherein the body of said block comprises a ceramic tile composition.

12. A paving block according to claim 7 wherein at least one of said vertical side surfaces further comprises at least one outwardly extending hub.

13. A paving block according to claim 1 wherein said opposing longer side surface is longer than said equal adjoining longer side surfaces by up to 10 percent.

14. A paving block according to claim 13 wherein the sides of the upper planar surface are beveled.

15. A paving block according to claim 13 wherein the body of said block comprises a brick composition.

16. A paving block according to claim 13 wherein the body of said block comprises a concrete composition.

17. A paving block according to claim 13 wherein the body of said block comprises a ceramic tile composition.

18. A paving block according to claim 13 wherein at least one of said vertical side surfaces further comprises at least one outwardly extending nub.

19. Ground, floor, and like surfaces covering comprising a combination of a plurality of pentagonal paving blocks according to claim 1 and at least one square paving block comprising a square planar upper surface and corresponding square planar lower surface and four vertical side surfaces extending between said upper and lower surfaces at each of the corresponding sides thereof, the height of said four side surfaces being equal to the height of the side surfaces of said pentagonal paving blocks, and the length of said side surfaces being equal to the length of said adjoining longer side surfaces of said pentagonal paving blocks.

20. Ground, floor, and like surfaces covering according to claim 19, said combination further comprising at least one configuration of four pentagonal paving blocks and one square paving block, juxtaposed so that the opposing third longer side surface of each pentagonal block corresponds with one of the side surfaces of each square block so that a vertical plane perpendicular to and bisecting said opposing third longer side surface of each pentagonal block would bisect the corresponding side surface of said square block.

21. A paving block for covering the ground, floor, and like surfaces comprising a body having a five-sided planar upper surface and corresponding parallel five-sided planar lower surface and five vertical side surfaces extending between said upper and lower surfaces at each of the corresponding sides thereof, said side surfaces including three longer side surfaces of essentially equal length and two shorter side surfaces of essentially equal length, two of said longer side surfaces being joined at one end at a 90° internal angle and each being further joined at its opposite end to an end of one of said shorter side surfaces at a 90° internal angle, with the opposite ends of said shorter side members each being joined at a 135° internal angle by a third opposing longer side surface said opposing longer side surface being perpendicular to and bisected by a vertical plane bisecting the 90° internal angle between said adjoining longer side surfaces.

22. A paving block according to claim 21 wherein the sides of the upper planar surface are beveled.

23. A paving block according to claim 21 wherein the body of said block comprises a brick composition.

24. A paving block according to claim 21 wherein the body of said block comprises a concrete composition.

25. A paving block according to claim 21 wherein the body of said block comprises a ceramic tile composition.

26. A paving block according to claim 21 wherein at least one of said vertical side surfaces further comprises at least one outwardly extending nub.

27. Ground, floor, and like surfaces covering comprising a combination of a plurality of pentagonal paving blocks according to claim 21 and at least one square paving block comprising a square planar upper surface and corresponding square planar lower surface and four vertical side surfaces extending between said upper and lower surfaces at each of the corresponding sides thereof, the height of said four side surfaces being equal to the height of the side surfaces of said pentagonal paving blocks, and the length of said side surfaces being equal to the length of said adjoining longer side surfaces of said pentagonal paving blocks.

28. Ground, floor, and like surfaces covering according to claim 27, said combination further comprising at least one configuration of four pentagonal paving blocks and one square paving block, juxtaposed so that the opposing third longer side surface of each pentagonal block corresponds with one of the side surfaces of each square block so that a vertical plane perpendicular to and bisecting said opposing third longer side surface of each pentagonal block would bisect the corresponding side surface of said square block.

29. A paving block for covering the ground, floor, and like surfaces comprising a body having a five-sided planar upper surface and corresponding parallel five-sided planar lower surface and five vertical side surfaces extending between said upper and lower surfaces at each of the corresponding sides thereof, said side surfaces including three longer side surfaces, two of said longer side surfaces being of essentially equal length, with a third longer side surface being longer by up to 10 percent than said two equal longer side surfaces of essentially equal length and two short side surfaces of essentially equal length, two of said longer side surfaces of equal length being joined at one end at a 90° internal angle, and being further joined at its opposite end to an end of one of said shorter side surfaces at a 90° internal angle, with the opposite ends of said shorter side members each being joined at a 135° internal angle by a third opposing longer side surface which is longer by up to 10 percent than said equal longer side surfaces, said opposing longer side surface being perpendicular to and bisected by a vertical plane bisecting the 90° internal angle between said equal adjoining longer side surfaces.

30. A paving block according to claim 29 wherein the sides of the upper planar surface are beveled.

31. A paving block according to claim 29 wherein the body of said block comprises a brick composition.

32. A paving block according to claim 29 wherein the body of said block comprises a concrete composition.

33. A paving block according to claim 29 wherein the body of said block comprises a ceramic tile composition.

34. A paving block according to claim 29 wherein at least one of the vertical side surfaces comprises at least one outwardly extending nub.

35. Ground, floor, and like surfaces covering comprising a combination of a plurality of pentagonal paving blocks according to claim 29 and at least one square paving block comprising a square planar upper surface and corresponding square planar lower surface and four vertical side surfaces extending between said upper and lower surfaces at each of the corresponding sides thereof, the height of said four side surfaces being equal to the height of the side surfaces of said pentagonal paving blocks, and the length of said side surfaces being equal to the length of said adjoining longer side surfaces of said pentagonal paving blocks.

36. Ground, floor, and like surfaces covering according to claim 35, said combination further comprising at least one configuration of four pentagonal paving blocks and one square paving block, juxtaposed so that the opposing third longer side surface of each pentagonal block corresponds with one of the side surfaces of each square block so that a vertical plane perpendicular to and bisecting said opposing third longer side surface of each pentagonal block would bisect the corresponding side surface of said square block.

* * * * *